US009702121B2

(12) United States Patent
Tanaka et al.

(10) Patent No.: US 9,702,121 B2
(45) Date of Patent: Jul. 11, 2017

(54) STATE INFORMATION DISPLAY FOR WORK MACHINE, CAUTION-SIGN DISPLAYING METHOD FOR WORK MACHINE, AND CAUTION-SIGN DISPLAYING PROGRAM FOR WORK MACHINE

(71) Applicant: Komatsu Ltd., Minato-ku, Tokyo (JP)

(72) Inventors: Osamu Tanaka, Hiratsuka (JP); Takehiro Shibata, Kanagawa (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 0 days.

(21) Appl. No.: 14/767,528

(22) PCT Filed: Dec. 26, 2014

(86) PCT No.: PCT/JP2014/084672
§ 371 (c)(1),
(2) Date: Aug. 12, 2015

(87) PCT Pub. No.: WO2015/088048
PCT Pub. Date: Jun. 18, 2015

(65) Prior Publication Data

US 2016/0186413 A1 Jun. 30, 2016

(51) Int. Cl.
*E02F 9/26* (2006.01)
*G09G 5/14* (2006.01)
(Continued)

(52) U.S. Cl.
CPC ..... *E02F 9/267* (2013.01); *E02F 3/84* (2013.01); *G07C 5/006* (2013.01); *G07C 5/0808* (2013.01);
(Continued)

(58) Field of Classification Search
CPC ..... E02F 9/267; G07C 5/0808; G07C 5/0825; G09G 5/14; G09G 2320/10; G09G 2380/10
(Continued)

(56) References Cited

U.S. PATENT DOCUMENTS 5,061,917 A * 10/1991 Higgs ..... B60C 23/0408 340/447
8,847,745 B2 * 9/2014 Shibamori ..... E02F 9/267 340/438
(Continued)

FOREIGN PATENT DOCUMENTS

JP 11-81393 A 7/1989
JP 2002-121776 A 4/2002
(Continued)

OTHER PUBLICATIONS

International Search Report dated Mar. 31, 2015 from corresponding International Patent Application No. PCT/JP2014/084672, 2 pages.

*Primary Examiner* — Atul Trivedi
(74) *Attorney, Agent, or Firm* — Fish & Richardson P.C.

(57) ABSTRACT

A state information display for a work machine displays plural kinds of state information of the machine including first and second state information, and includes: a state information displaying unit defining first and second display areas respectively displaying the first and second state information; and a display controller controlling the entire display including the unit and including: a malfunction information determining unit receiving the plural kinds of state information and determining whether or not the state information includes malfunction information indicating a malfunction of the machine; a first display switching unit switching the first state information in the first display area with a caution sign for reporting the malfunction, when the
(Continued)

unit determines the malfunction information is received; and a second display switching unit switching the second state information in the second display area with the first state information, when the first state information is switched with the caution sign.

7 Claims, 8 Drawing Sheets

(51) Int. Cl.
*G07C 5/08* (2006.01)
*E02F 3/84* (2006.01)
*G07C 5/00* (2006.01)

(52) U.S. Cl.
CPC ..... *G07C 5/0825* (2013.01); *G09G 5/14* (2013.01); *G09G 2320/10* (2013.01); *G09G 2380/10* (2013.01)

(58) Field of Classification Search
USPC ..... 701/29.1
See application file for complete search history.

(56) References Cited

U.S. PATENT DOCUMENTS 8,854,183 B2 * 10/2014 Komine ..... G05B 19/0428 340/10.1
8,983,785 B2 * 3/2015 Panko ..... G01R 13/029 324/113
9,133,602 B2 * 9/2015 Ooki ..... E02F 9/123
2002/0015018 A1 * 2/2002 Shimazu ..... E02F 9/26 345/102
2002/0015062 A1 * 2/2002 Shimazu ..... B60K 37/02 715/772
2005/0151845 A1 * 7/2005 Tsukada ..... E02F 9/26 348/148
2007/0171087 A1 7/2007 Shimazu et al.
2013/0035824 A1 * 2/2013 Nakamura ..... B60K 35/00 701/36
2013/0110348 A1 * 5/2013 Jinbo ..... E02F 9/26 701/36
2013/0176120 A1 7/2013 Shibamori et al.
2014/0058635 A1 * 2/2014 Furukawa ..... B60R 16/02 701/50
2014/0099178 A1 * 4/2014 Nomura ..... E02F 3/32 414/685
2014/0100712 A1 * 4/2014 Nomura ..... E02F 3/32 701/1
2014/0190046 A1 * 7/2014 Shibata ..... E02F 3/964 37/403
2014/0257645 A1 * 9/2014 Date ..... E02F 9/267 701/50
2015/0020026 A1 * 1/2015 Miyamoto ..... E02F 9/26 715/809
2015/0240448 A1 * 8/2015 Mori ..... E02F 9/0808 701/50
2015/0246613 A1 * 9/2015 Shimazu ..... B60K 35/00 701/102
2015/0354178 A1 * 12/2015 Jeong ..... E02F 9/267 340/438
2016/0186413 A1 * 6/2016 Tanaka ..... G07C 5/006 701/29.1
2016/0193923 A1 * 7/2016 Kim ..... B60K 35/00 296/70
2016/0334623 A1 * 11/2016 Kishi ..... G08G 1/0962
2017/0030054 A1 * 2/2017 Okumura ..... H04N 5/247

FOREIGN PATENT DOCUMENTS

JP 2007-276585 A 10/2007
JP 2012-072617 A 4/2012
JP 2012-117339 A 6/2012

* cited by examiner

STATE INFORMATION DISPLAY FOR WORK MACHINE, CAUTION-SIGN DISPLAYING METHOD FOR WORK MACHINE, AND CAUTION-SIGN DISPLAYING PROGRAM FOR WORK MACHINE

CROSS-REFERENCE TO RELATED APPLICATIONS

This application claims priority to International Application No. PCT/JP2014/084672 filed on Dec. 26, 2014, which application is incorporated herein by reference in its entirety.

TECHNICAL FIELD

The present invention relates to a state information display installed in a work machine to display plural kinds of state information of the work machine, a caution-sign displaying method for a work machine, and a caution-sign displaying program for a work machine.

BACKGROUND ART

According to a typical known technique, a display such as a liquid crystal display is installed in a cab of a work machine such as a wheel loader and a motor grader, and plural kinds of state information of the work machine, which include driving speed, engine speed, hydraulic oil temperature, torque converter oil temperature and fuel amount, are displayed on a screen of the display (see, for instance, Patent Literature 1). An operator of the work machine operates the work machine, monitoring the screen.

According to another known technique, a display in a wheel-type work machine is capable of switching information on a screen. Specifically, during the traveling of the work machine, the screen shows information including driving speed and engine speed, whereas, when the work machine is in operation (e.g., a crane of the work machine is in operation), the screen shows information including the lifting state of the crane (see, for instance, Patent Literature 2).

Further, according to still another known technique, a screen, which normally shows the state information of a work machine, shows a caution sign in the case of a malfunction of a part of the work machine (see, for instance, Patent Literatures 3 and 4).

CITATION LIST

Patent Literature(s)

Patent Literature 1: JP-A-2002-121776
Patent Literature 2: JP-A-2007-276585
Patent Literature 3: JP-A-11-81393
Patent Literature 4: JP-A-2012-72617

SUMMARY OF THE INVENTION

Problems to be Solved by the Invention

A work machine such as a motor grader or a bulldozer is provided with a blade disposed near the ground to perform operations such as banking and ground leveling, and an operator in a cab needs to look directly at the blade during the operation. Therefore, such a work machine has to be designed to ensure a sufficient lower front visibility.

Accordingly, a display installed in a motor grader or a bulldozer should preferably be downsized as much as possible.

However, even though the size of the monitor display is small, many kinds of state information of the work machine need to be displayed in order to operate the work machine. It is thus difficult to determine an area in the screen where a caution sign is to be displayed in the case of a malfunction of a part of the work machine.

An object of the invention is to provide: a state information display for a work machine capable of displaying a caution sign to an operator in an easily visible manner while displaying state information necessary for operation irrespective of the size of the state information display for the work machine; a caution-sign displaying method for a work machine; and a caution-sign displaying program for a work machine.

Means for Solving the Problems

According to a first aspect of the invention, a state information display for a work machine, the state information display being provided to the work machine to display plural kinds of state information of the work machine including first state information and second state information, the state information display includes: a state information displaying unit defining a first display area that displays the first state information and a second display area that displays the second state information; and a display controller configured to control the state information displaying unit, the display controller including: a malfunction information determining unit configured to receive the plural kinds of state information and determine whether or not the plural kinds of state information include malfunction information indicating a malfunction of the work machine; a first display switching unit configured to switch the first state information displayed in the first display area with a caution sign for reporting the malfunction, when the malfunction information determining unit determines that the malfunction information is received; and a second display switching unit configured to switch the second state information displayed in the second display area with the first state information, when the first display switching unit switches the first state information with the caution sign.

The caution sign is information that should be reported to an operator of the work machine as soon as possible, and thus the display priority of the caution sign is higher than those of the first and second state information. In the state information of the work machine, the first state information is more necessary than the second state information in terms of the state of the work machine, and thus has a higher display priority than the second state information.

In the first aspect, when the malfunction information determining unit receives the malfunction information of the work machine, the first display switching unit switches the first state information with the caution sign to display the caution sign. An operator of the work machine can thus be reliably informed of the malfunction. Further, the second display switching unit switches the second state information with the first state information to display the first state information, so that the operator can see the information necessary for operating the work machine while operating.

Further, information with a higher display priority such as the caution sign and the first state information is switched to be displayed in place of information with a lower display priority so that an operator can sufficiently obtain information necessary for operating the work machine. The state information display can thus be downsized and is, consequently, suitably usable in a work machine required to provide a lower visibility, such as a motor grader or a bulldozer with a blade disposed near the ground.

According to a second aspect of the invention, in the state information display for the work machine of the first aspect, each of the first state information and the second state information is numerical information.

In the second aspect, the first state information, which is numerical information, is switched to be displayed in the second display area intended for displaying numerical information. Therefore, the display area of the first state information can be switched without distracting an operator of the work machine.

According to a third aspect of the invention, in the state information display for the work machine of the first or second aspect, the first display area is larger than the second display area.

In the third aspect, information of high importance can be displayed in a large size to be reliably visible to an operator.

According to a fourth aspect of the invention, in the state information display for the work machine of any one of the first to third aspects, the plural kinds of state information further include third state information, the state information displaying unit further defines a third display area that displays the third state information, and the display controller further includes a third display switching unit configured to switch the third state information displayed in the third display area with a malfunction level sign, when the malfunction information determining unit determines that the malfunction information is received, the malfunction level sign indicating a level of the malfunction related to the caution sign displayed in the first display area.

In the fourth aspect, when the work machine has a malfunction and the caution sign is displayed in the first display area, the third display switching unit can display the malfunction level of the malfunction related to the caution sign in the third display area. Therefore, an operator, who deals with the malfunction, can find the urgency of the malfunction.

According to a fifth aspect of the invention, in the state information display for the work machine of any one of the first to fourth aspects, the caution sign includes a plurality of caution signs, the malfunction information includes plural kinds of malfunction information, and when the malfunction information determining unit receives ones of the plural kinds of malfunction information, the first display switching unit displays ones of the plurality of caution signs in accordance with the received ones of the plural kinds of malfunction information.

In the fifth aspect, the first display switching unit can display the plurality of caution signs. Therefore, even when the work machine has a plurality of malfunctions, an operator can be informed of all the malfunctions.

According to a sixth aspect of the invention, a caution-sign displaying method for a work machine, the method being configured to allow a state information display provided to the work machine to display a caution sign, the state information display being configured to display plural kinds of state information of the work machine including first state information and second state information, the state information display including: a state information displaying unit defining a first display area that displays the first state information and a second display area that displays the second state information; and a display controller configured to control the state information displaying unit and to perform the method, the method includes: receiving the plural kinds of state information; determining whether or not the plural kinds of state information include malfunction information indicating a malfunction of the work machine; switching the first state information displayed in the first display area with the caution sign for reporting the malfunction, when it is determined that the malfunction information is received; and switching the second state information displayed in the second display area with the first state information, when the first state information is switched with the caution sign.

According to a seventh aspect of the invention, a computer-readable caution-sign displaying program for a work machine, the program being configured to allow a state information display provided to the work machine to perform a caution-sign displaying method for the work machine, the method being configured to allow the state information display to display a caution sign, the state information display being configured to display plural kinds of state information of the work machine including first state information and second state information, the state information display including: a state information displaying unit defining a first display area that displays the first state information and a second display area that displays the second state information; and a display controller configured to control the state information displaying unit and to perform the method, the method includes: receiving the plural kinds of state information; determining whether or not the plural kinds of state information include malfunction information indicating a malfunction of the work machine; switching the first state information displayed in the first display area with the caution sign for reporting the malfunction, when it is determined that the malfunction information is received; and switching the second state information displayed in the second display area with the first state information, when the first state information is switched with the caution sign.

The sixth and seventh aspects provide the same advantageous effect(s) as described above.

DESCRIPTION OF EMBODIMENT(S)

Exemplary embodiment(s) of the invention will be described below with reference to the attached drawings.

[1] Overall Arrangement of Motor Grader 1

Figure 1:
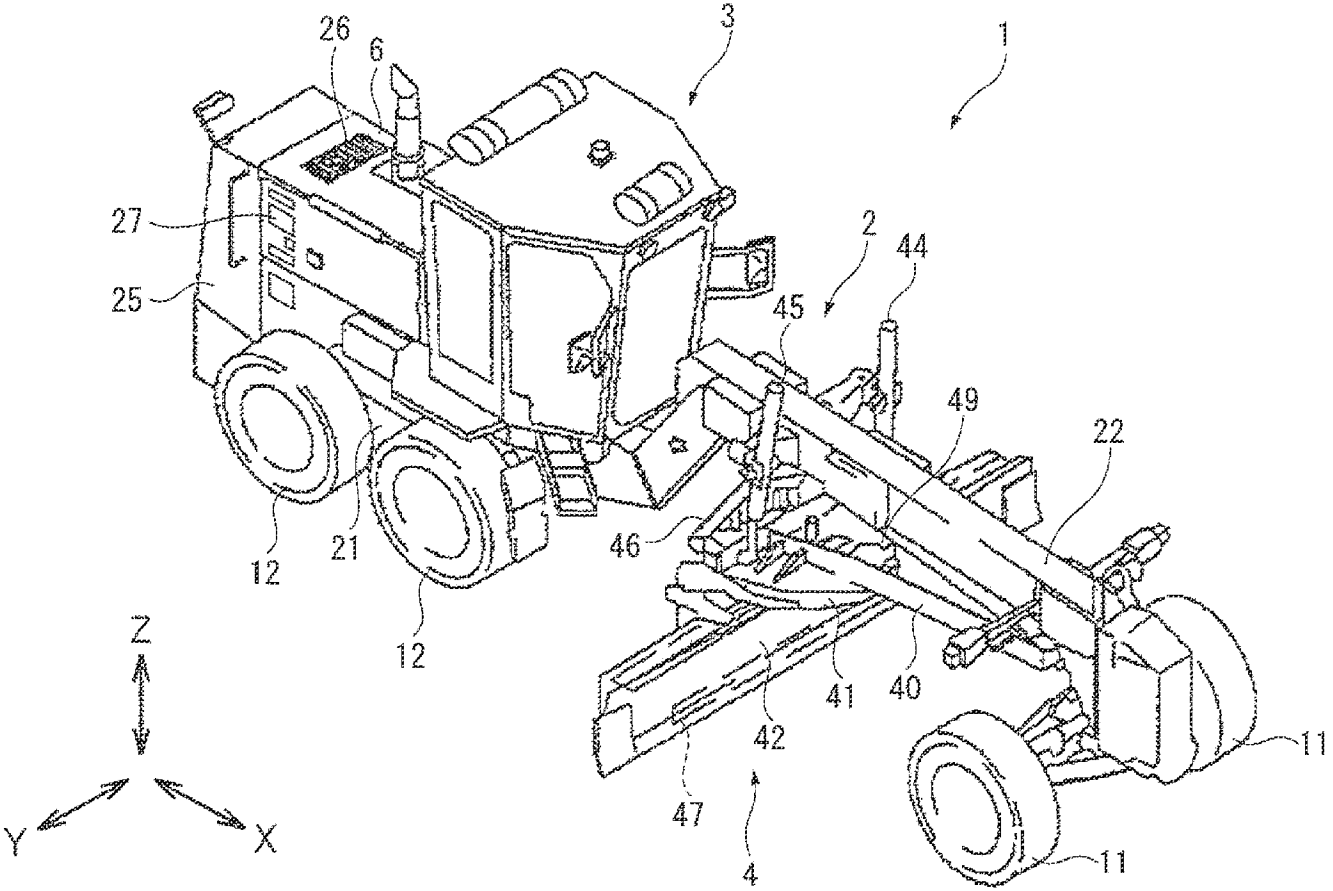
FIG. 1 is a perspective view showing a work machine according to an exemplary embodiment of the invention.
Figure 2:
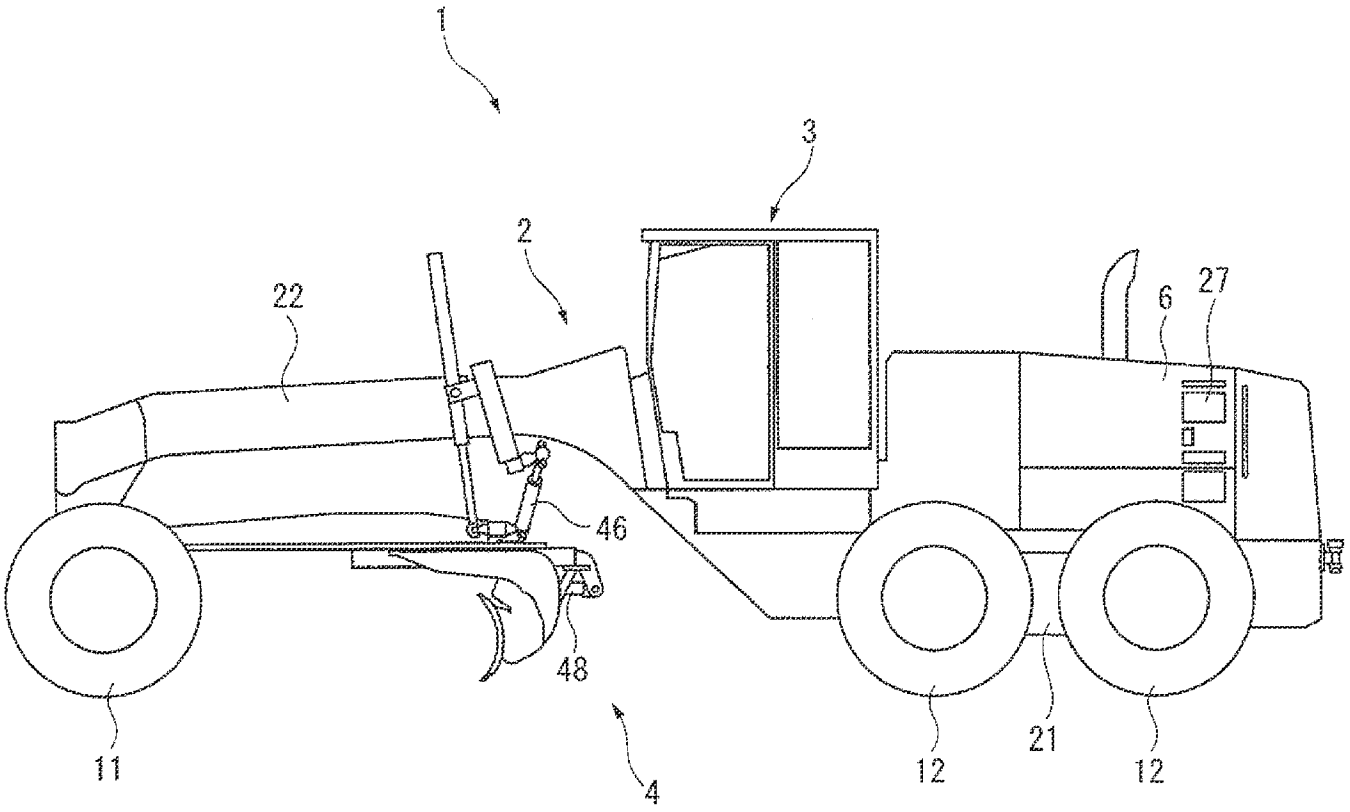
FIG. 2 is a side view showing the work machine according to the exemplary embodiment.

FIGS. 1 and 2 show a motor grader 1 according to an exemplary embodiment of the invention. The motor grader 1, which is a working vehicle for operations such as ground leveling, snowplowing, light cutting and material mixing, includes front wheels 11, rear wheels 12, a vehicle body frame 2, a cab 3 and working equipment 4.

An engine compartment 6 is provided behind the cab 3, and components of an engine and the like are housed in the engine compartment 6.

The front wheels 11 are provided to a front end of the vehicle body frame 2. The rear wheels 12 are provided near a rear end of the vehicle body frame 2. It should be noted that the front wheels 11 include two wheels and the rear wheels 12 include four wheels in the exemplary embodiment, but this arrangement is not requisite.

The vehicle body frame 2 includes a rear frame 21, a front frame 22 and an exterior cover 25.

The rear frame 21 supports the exterior cover 25 and components such as the engine disposed in the engine compartment 6. The exterior cover 25 covers the engine compartment 6. The exterior cover 25 is provided with an upper opening 26, a lateral opening 27 and a rear opening (not shown). The upper opening 26, the lateral opening 27 and the rear opening penetrate the exterior cover 25 in a thickness direction.

For instance, the four rear wheels 12 are each attached to the rear frame 21 to be rotatable with a driving force from the engine. The front frame 22 is swingably attached in front of the rear frame 21, and the two front wheels 11 are rotatably attached to a front end of the front frame 22.

The cab 3 is mounted on the front frame 22. In the cab 3, operating units such as a steering handle, transmission lever, an operation lever for the working equipment 4, a brake, an accelerator pedal and an inching pedal (described later) are provided. It should be noted that the cab 3 may be mounted on the rear frame 21.

The working equipment 4 includes a draw bar 40, a circle 41, a blade 42, a hydraulic motor 49, and a variety of hydraulic cylinders 44 to 48.

A front end of the draw bar 40 is swingably attached to the front end of the front frame 22.

A rear end of the draw bar 40 is supported by the front frame 22 via a pair of lift cylinders 44, 45. A synchronized extension and retraction of the pair of lift cylinders 44, 45 causes a vertical movement of the rear end of the draw bar 40 relative to the front frame 22. Further, an independent extension and retraction of each of the lift cylinders 44, 45 causes a vertical swinging movement of the draw bar 40 around a shaft along a vehicle-traveling direction.

A draw-bar shift cylinder 46 is attached to the front frame 22 and a lateral end of the draw bar 40. Extension and retraction of the draw-bar shift cylinder 46 causes the draw bar 40 to move right and left relative to the front frame 22.

The circle 41 is rotatably attached to the rear end of the draw bar 40. The circle 41 is driven by the hydraulic motor 49 to rotate around the draw bar 40 in a clockwise or anticlockwise direction when viewed from above the vehicle.

The blade 42 is supported to be slidable in a right-and-left direction relative to the circle 41 and vertically swingable around a shaft parallel with the right-and-left direction. Specifically, a blade shift cylinder 47 is attached to the circle 41 and the blade 42 to be disposed along a longitudinal direction of the blade 42. The blade shift cylinder 47 allows the blade 42 to move in the right-and-left direction relative to the circle 41.

A tilt cylinder 48 is attached to the circle 41 and the blade 42. Extension and retraction of the tilt cylinder 48 causes the blade 42 to swing around a shaft parallel with the right-and-left direction relative to the circle 41 so that an orientation of the blade 42 is vertically changed. The tilt cylinder 48 can thus change an inclination angle of the blade 42 relative to the traveling direction.

As described above, with the assistance of the draw bar 40 and the circle 41, the blade 42 is configured to permit a vertical movement relative to the vehicle, a change in an inclination relative to the traveling direction, a change in an inclination relative to a lateral direction, rotation, and a shift in the right-and-left direction.

[2] Internal Arrangement of Cab 3

Figure 3:
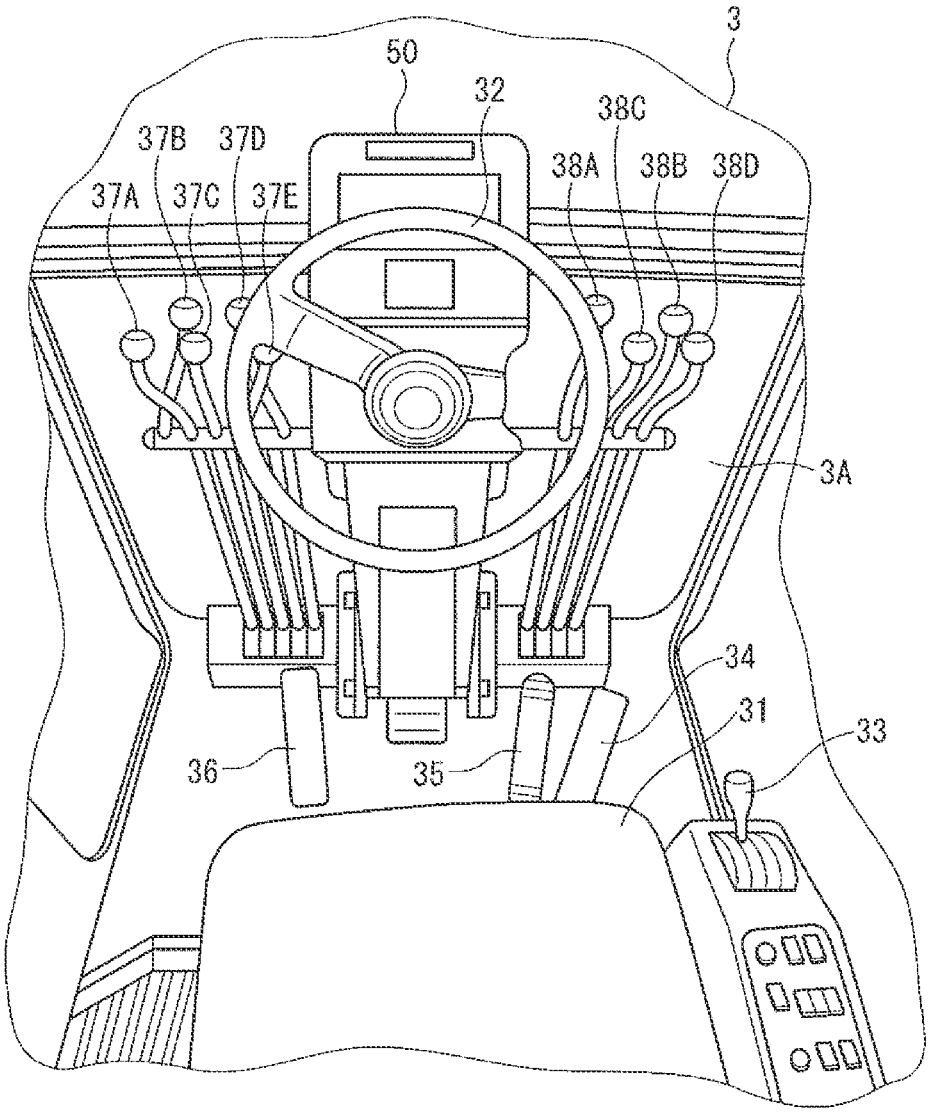
FIG. 3 is a perspective view showing an interior of a cab of the work machine according to the exemplary embodiment.

FIG. 3 shows an arrangement of an operator seat in the cab 3. A glass window 3A is provided to a lower front of the cab 3 to ensure a lower front visibility. A seat 31 for an operator to be seated is disposed at a center in the cab 3, and a steering handle 32 is disposed at a side facing the seat 31. A transmission lever 33 is disposed beside the seat 31. An accelerator pedal 34, a brake pedal 35 and an inching pedal 36 are disposed on a floor.

Levers for operating the working equipment 4 are disposed at the left of the steering handle 32, the levers including: a lever 37A for operating a left-blade-lift cylinder, a lever 37B for operating a scarifier, a lever 37C for rotating the blade, a lever 37D for an articulation operation, and a lever 37E for longitudinally feeding the draw bar.

Similarly, levers are disposed at the right of the steering handle 32, the levers including: a lever 38A for power-tilting, a lever 38B for leaning, an operation lever 38C for laterally feeding the blade, and a lever 38D for a right-blade-lift cylinder.

A state information display 50 is disposed behind the steering handle 32.

Since a lot of levers are disposed in the cab 3 to reduce the lower front visibility as described above, it is important to downsize the state information display 50 as much as possible to ensure the lower front visibility.

[3] Arrangement of State Information Display 50

Figure 4:
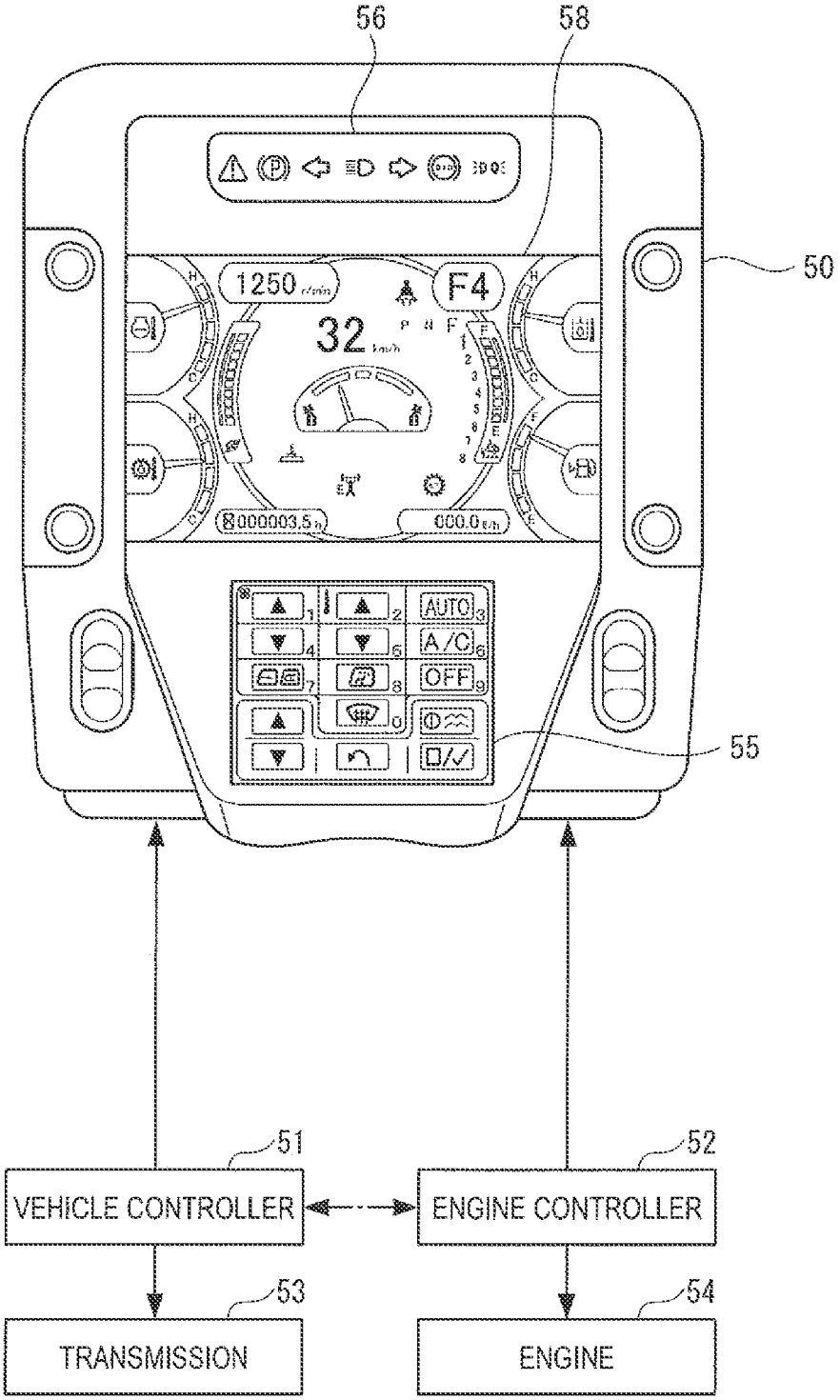
FIG. 4 is a schematic view showing a state information display for the work machine according to the exemplary embodiment.

FIG. 4 is a front view of the state information display 50 provided in the cab 3.

The state information display 50 is connected to a vehicle controller 51 and an engine controller 52 through electrical wiring. The vehicle controller 51 controls the vehicle based on detection values of sensors (not shown) including a temperature sensor and a pressure sensor provided to a driving system including a transmission 53 and a hydraulic circuit system including a hydraulic pump. The engine controller 52 controls the rotation speed of an engine 54 based on values of sensors (not shown) including a rotation speed sensor and a temperature sensor.

The detection values of the sensors provided to the vehicle controller 51 and the engine controller 52 are outputted to the state information display 50 through the electrical wiring.

The state information display 50 includes an operation switch panel 55, an LED indicator panel 56 and a display panel 58. It should be noted that the operation switch panel 55, the LED indicator panel 56 and the display panel 58 may be integral with one another or be independent of one another. The operation switch panel 56 and the LED indicator panel 57 are not requisite.

The operation switch panel 55 includes a variety of operation switches such as a wiper switch, an air-conditioner switch and a switch for switching the display panel 58. The operator can change the environment in the vehicle and the display state of the display panel 58 as desired by operating the operation switches of the operation switch panel 55.

The LED indicator panel 56 includes, for instance, a parking lamp, right-turn and left-turn lamps and a light-on lamp, which indicate a part of the operation state of the motor grader 1. The LED indicator panel 56 also includes a caution sign, which is lit up in red in the case where a trouble occurs somewhere in the motor grader 1.

The display panel 58, which includes, for instance, a liquid crystal display panel, displays the state in terms of plural aspects in further detail as compared with the LED indicator panel 56.

Figure 5:
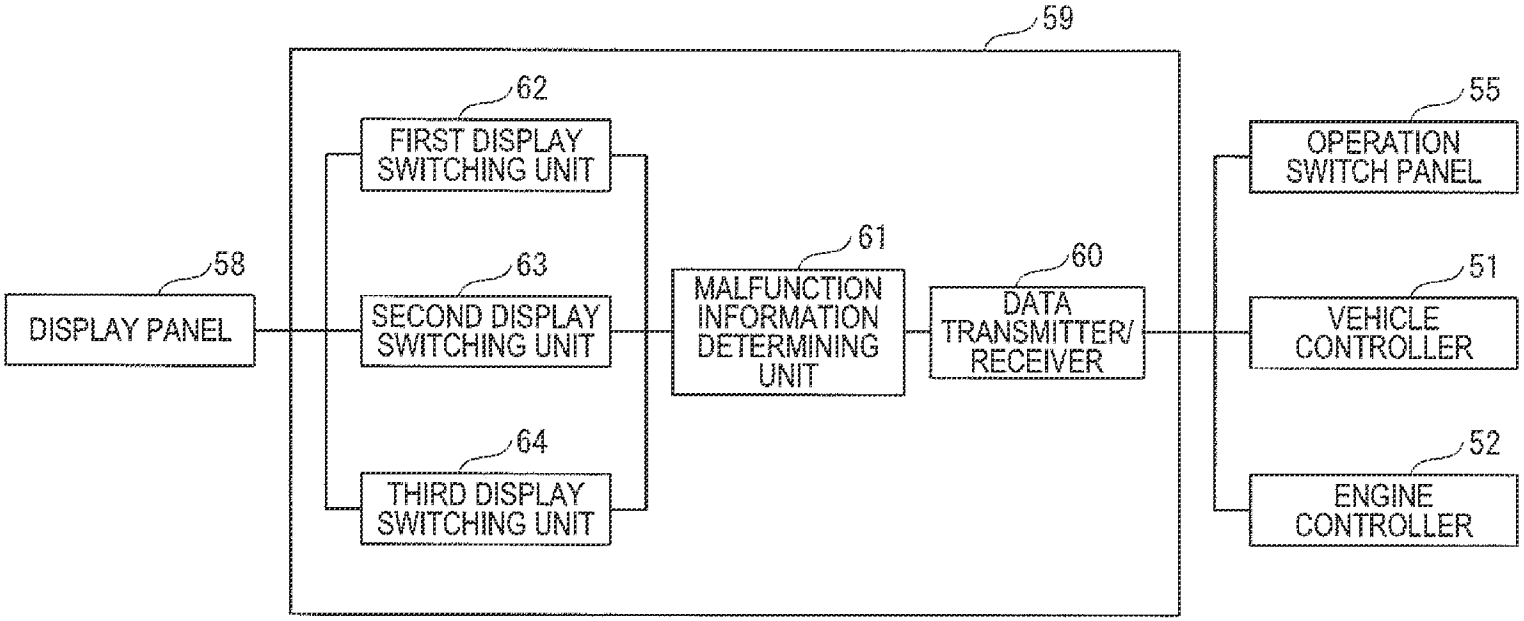
FIG. 5 is a block diagram showing an arrangement of the state information display according to the exemplary embodiment.

FIG. 5 is a functional block diagram of the state information display 50. The state information display 50 includes the display panel 58 (a state information displaying unit) and a display controller 59. The display controller 59 controls display of various kinds of state information of the motor grader 1 on the display panel 58 based on the detection values of the various sensors outputted from the vehicle controller 51 and the engine controller 52.

The display controller 59, which is configured to control the whole of the state information display 50 including the display panel 58, includes a data transmitter/receiver 60, a malfunction information determining unit 61, a first display switching unit 62, a second display switching unit 63 and a third display switching unit 64.

The data transmitter/receiver 60 receives the detection values of the various sensors outputted from the vehicle controller 51 and the engine controller 52, and outputs a setting signal of the operation switch of the operation switch panel 55 operated by the operator to the vehicle controller 51 and/or the engine controller 52 to change the setting of the vehicle controller 51 and/or the setting of the engine controller 52.

The malfunction information determining unit 61 determines whether or not the detection values of the sensors inputted from the vehicle controller 51 and/or the engine controller 52 via the data transmitter/receiver 60 includes any abnormal value. When determining that the abnormal value is included, the malfunction information determining unit 61 outputs information specifying a part having a malfunction and the details of the malfunction to the first display switching unit 62.

Upon detection of any abnormal value related to the driving system including the transmission 53, the hydraulic circuit system including the hydraulic pump, and/or an internal combustion system including the engine 54 from the vehicle controller 51 and the engine controller 52, the first display switching unit 62 switches state information displayed in a first display area defined in the display panel 58 of the state information display 50 with a caution sign.

The second display switching unit 63 switches information displayed in a second display area with the first state information having been switched in the first display area by the first display switching unit 62.

When the malfunction information determining unit 61 determines that the abnormal value is detected, the third display switching unit 64 displays the level of the malfunction of the specified part.

[4] State Information Displayed on Display Panel 58

Figure 6:
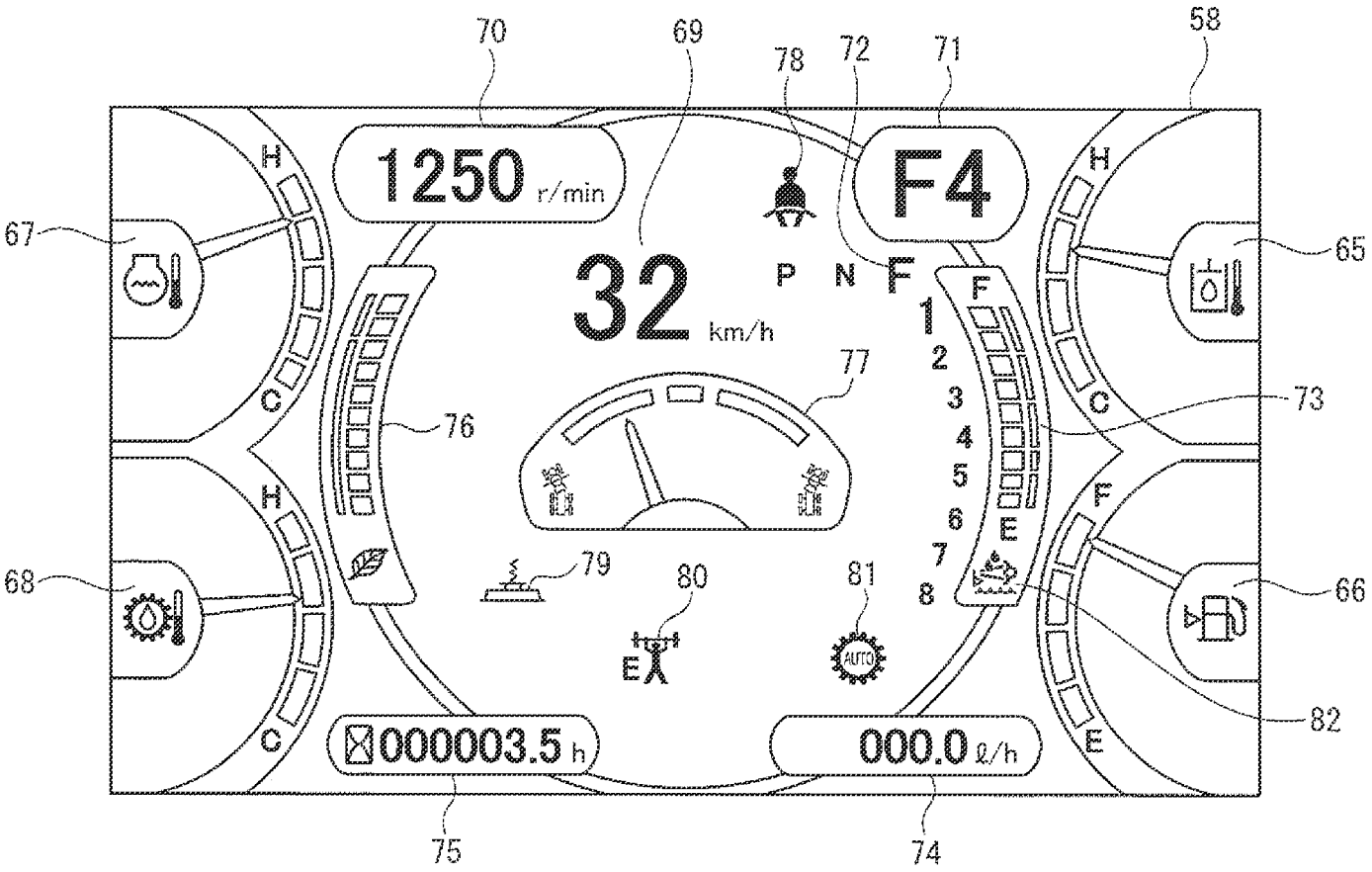
FIG. 6 is a schematic view showing a display area of the state information display according to the exemplary embodiment.

The state information of the motor grader 1 displayed on the display panel 58 will be described in detail with reference to FIG. 6.

Information about the engine, driving system and pump temperature is displayed at the four corners of the display panel 58. A hydraulic oil temperature in the hydraulic circuit of the working equipment 4 is displayed in an upper right area 65 of the display panel 58, and the remaining amount of an engine fuel is displayed in a lower right area 66.

An engine water temperature is displayed in an upper left area 67, and a torque converter oil temperature is displayed in a lower left area 68.

These kinds of state information are very important for operating the motor grader 1, and thus are constantly displayed when the motor grader 1 is in operation The vehicle speed of the motor grader 1 is displayed in an upper center area 69, and time is displayed in an area 70 at the left of the area 69. The area 70 is defined as the above first display area.

The actual gear position of the motor grader 1 is displayed in an area 71 at the right of the displayed vehicle speed, and a gear position preset using the transmission lever 33 is displayed in an area 72 below the area 71. The remaining amount of a urea aqueous solution in a urea selective catalytic reduction (SCR) system is displayed in an area 73 right adjacent to the area 72.

The fuel consumption of the motor grader 1 during operation is displayed in an area 74 below the area 73. The area 74 is defined as the above second display area. It should be noted that the information displayed in the area 74 can be changed by operating the operation switch(es). In the exemplary embodiment, fuel consumption, travel distance, time and engine operating time can be switched to be displayed in the area 74. An area 75 at the left of the area 74 displays the engine operating time, but plural kinds of information such as travel distance and time can be switched to be displayed in the area 75 in the same manner as in the area 74.

Further, an eco gauge is displayed in an area 76 to show whether or not the motor grader 1 is in an energy-saving operation, and an articulation angle of the motor grader 1 is displayed in an area 77 defined substantially at the center of the display panel 58. The area 77 is defined as a third display area.

An area 78 displays whether or not a seat belt is fastened. An area 79 displays whether or not a blade accumulator is in operation. An area 80 displays whether the motor grader 1 works in a heavy-load operation mode (P mode) or in a light-load operation mode (E mode). An area 81 displays whether or not the working equipment 4 is in an automatic operation. An area 82 displays an icon indicating the amount of soot deposited on a diesel particulate filter (DPF).

Among the above information of the motor grader 1 displayed on the display panel 58 of the state information display 50, the information about the vehicle speed displayed in the area 69, the information about the engine speed displayed in the first display area 70, and the information about the gear position displayed in the display areas 71, 72 are especially important for operating the motor grader 1, and these kinds of information should be more emphasized during operation than information such as fuel consumption, travel distance, time and engine operating time.

[5] Process and Advantage(s) of Exemplary Embodiment

Figure 7:
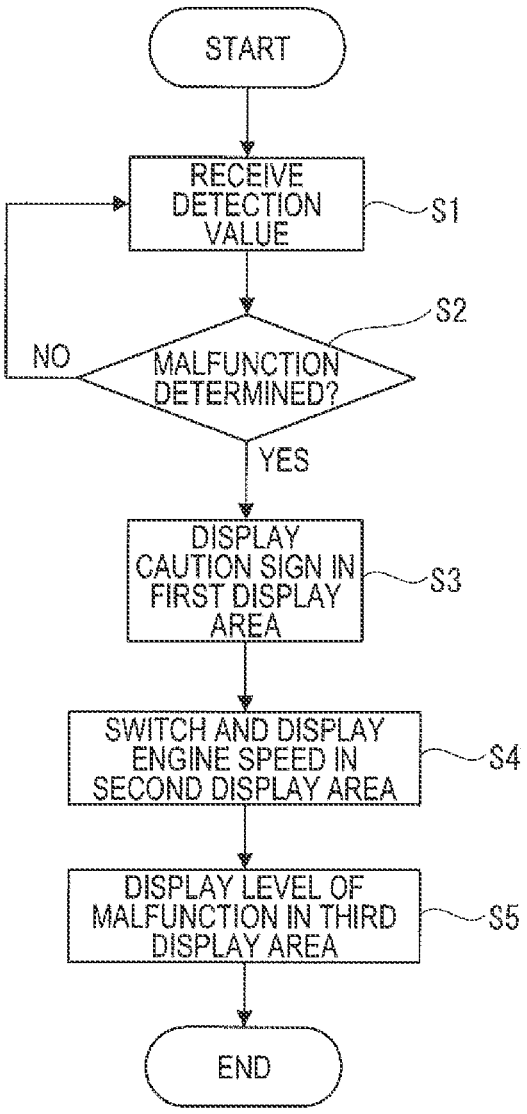
FIG. 7 is a flow chart for illustrating a process according to the exemplary embodiment.

Next, a process according to the exemplary embodiment will be described with reference to a flow chart shown by FIG. 7. It should be noted that the process of the flow chart shown by FIG. 7 is configured in the form of, for instance, a computer program and performed by the display controller 59.

The malfunction information determining unit 61 first receives the detection values of the sensors inputted from the vehicle controller 51 and the engine controller 52 via the data transmitter/receiver 60 (step S1), and determines whether or not any malfunction information is included (step S2). It should be noted that, when any malfunction information is included, the malfunction information determining unit 61 also determines the level of the malfunction.

Figure 8:
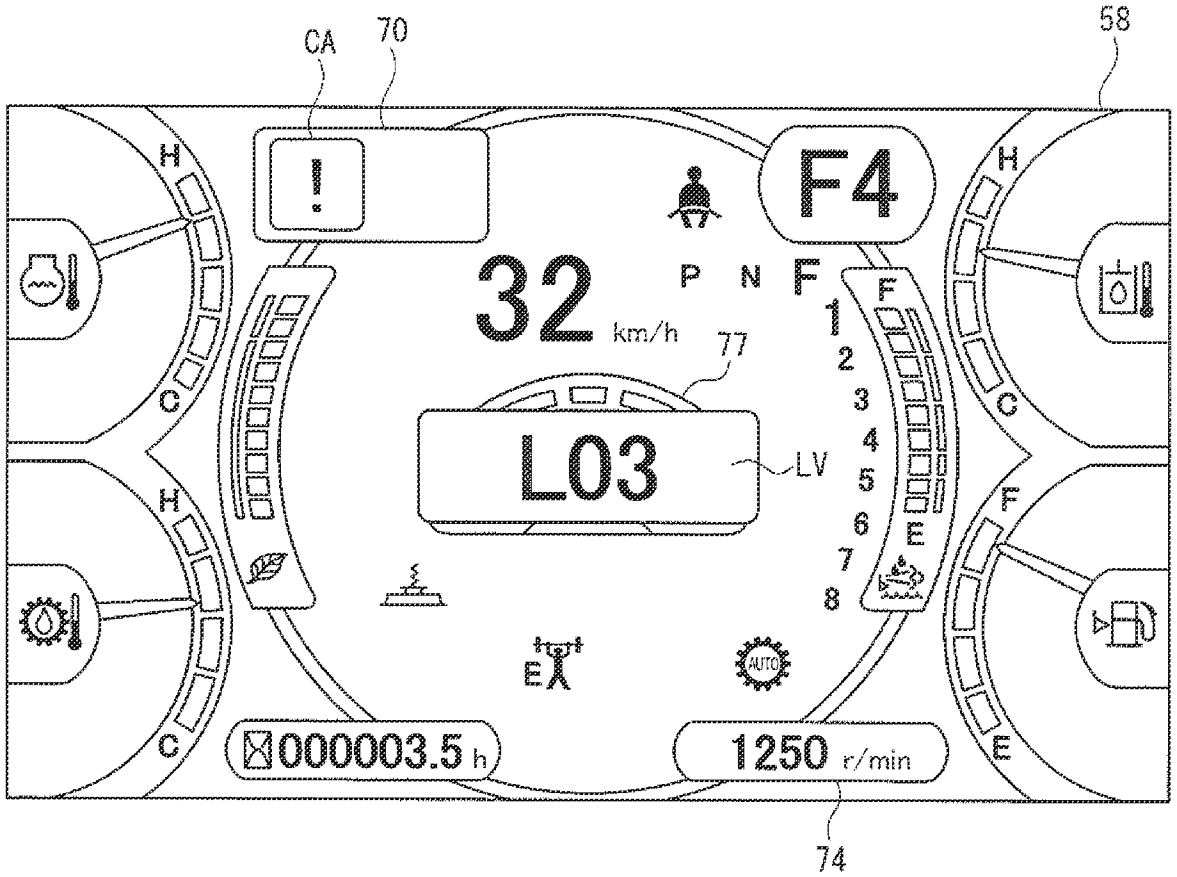
FIG. 8 is a schematic view showing a caution sign appearing in a display area of the state information display according to the exemplary embodiment.

When the malfunction information determining unit 61 determines that the detection values of the sensors received via the data transmitter/receiver 60 include any malfunction information, the first display switching unit 62 switches the information of the engine speed displayed in the first display area 70 (see FIG. 6) with a caution sign CA as shown in FIG. 8 (step S3). It should be noted that the caution sign CA includes plural kinds of signs so that, when the malfunction information determining unit 61 receives plural kinds of malfunction information, the first display switching unit 62 can display other caution sign(s) adjacent to the caution sign CA displayed in the first display area 70.

Subsequently, the second display switching unit 63 switches the information of the fuel consumption displayed in the second display area 74 (see FIG. 6) with the information of the engine speed, which was displayed in the first display area 70 (step S4).

Further, the third display switching unit 64 displays a malfunction level sign LV corresponding to the malfunction information received by the malfunction information determining unit 61 in the third display area 77 (step S5). It should be noted that the exemplary embodiment uses four malfunction levels of LV01 to LV04, which indicates malfunction levels gradually raised in this sequence. When the malfunction level is LV01, the third display switching unit 64 turns off the malfunction level sign after the elapse of a predetermined duration of time and again displays the articulation angle. However, when the malfunction level is LV02 or higher, the malfunction level sign is constantly displayed during the operation of the motor grader 1 due to the urgency of the malfunction.

In the exemplary embodiment, when the malfunction information determining unit 61 receives the malfunction information of the motor grader 1, the first display switching unit 62 switches the first state information with the caution sign CA to display the caution sign CA. An operator of the motor grader 1 can thus be reliably informed of the malfunction. Similarly, the second display switching unit 63 switches the second state information (i.e., the information of the engine speed) with the first state information to display the first state information, so that the operator can see the information necessary for operating the motor grader 1 while operating.

Further, information with a higher display priority such as the caution sign CA and the information of the engine speed is switched to be displayed in place of information with a lower display priority so that an operator can sufficiently obtain information necessary for operating the motor grader 1. The state information display 50 can thus be downsized, so that the blade 42 of the motor grader 1, which is disposed near the ground, is easily visible to an operator who operates the motor grader 1.

Since the first and second state information is numerical information about the engine speed and the fuel consumption, the display area(s) of such information can be switched without distracting the operator of the motor grader 1.

Further, since the first display area 70 is larger than the second display area 74, the caution sign CA, which is information of high importance, can be displayed in a large size to be reliably visible to an operator.

[6] Modification(s) of Exemplary Embodiment

Incidentally, it should be understood that the scope of the invention is not limited to the above-described exemplary embodiment, but includes modifications and improvements compatible with the invention.

For instance, the invention is applied to the motor grader 1 in the exemplary embodiment, but may be applied to a bulldozer or a wheel loader.

The information of the engine speed is displayed in the first display area 70, whereas the information of the fuel consumption is displayed in the second display area 74 in the exemplary embodiment. However, other display areas may alternatively be defined as the first and second display areas so that the caution sign can be switched to be displayed. For instance, the first display area may display any one of engine speed, vehicle speed, transmission gear position, engine water temperature, torque converter oil temperature, hydraulic oil temperature, the remaining amount of fuel, the remaining amount of a urea solution, the amount of soot deposited on the DPF, articulation angle, and camera image, whereas the second display area may display any one of fuel consumption, travel distance, engine operating time, operation mode, drive mode, eco mode, maintenance information, time, temperature, air volume, the setting of an air conditioner, and the setting of a radio. It should be noted that information to be displayed in the first display area and information to be displayed in the second display area may be determined as desired.

The invention claimed is:

1. A state information display for a work machine, the state information display being provided to the work machine to display plural kinds of state information of the work machine comprising first state information and second state information, the state information display comprising:

a state information displaying unit defining a first display area that displays the first state information and a second display area that displays the second state information; and a display controller configured to control the state information displaying unit, the display controller comprising:

a malfunction information determining unit configured to receive the plural kinds of state information and determine whether or not the plural kinds of state information comprise malfunction information indicating a malfunction of the work machine;

a first display switching unit configured to, based on the malfunction information determining unit determining that the malfunction information is received, switch the first state information displayed in the first display area with a caution sign for reporting the malfunction information determined to be comprised in the plural kinds of state information by the malfunction information determining unit; and a second display switching unit configured to, based on the first display switching unit switching the first state information with the caution sign, switch the second state information displayed in the second display area with the first state information.

2. The state information display for the work machine according to claim 1, wherein each of the first state information and the second state information is numerical information.

3. The state information display for the work machine according to claim 1, wherein the first display area is larger than the second display area.

4. The state information display for the work machine according to claim 1, wherein the plural kinds of state information further comprise third state information, the state information displaying unit further defines a third display area that displays the third state information, and the display controller further comprises a third display switching unit configured to, based on the malfunction information determining unit determining that the malfunction information is received, switch the third state information displayed in the third display area with a malfunction level sign, the malfunction level sign indicating a level of the malfunction related to the caution sign displayed in the first display area.

5. The state information display for the work machine according to claim 1, wherein the caution sign comprises a plurality of caution signs, the malfunction information comprises plural kinds of malfunction information, and based on the malfunction information determining unit receiving ones of the plural kinds of malfunction information, the first display switching unit displays ones of the plurality of caution signs in accordance with the received ones of the plural kinds of malfunction information.

6. A caution-sign displaying method for a work machine, the method being configured to allow a state information display provided to the work machine to display a caution sign, the state information display being configured to display plural kinds of state information of the work machine comprising first state information and second state information, the state information display comprising:

a state information displaying unit defining a first display area that displays the first state information and a second display area that displays the second state information; and a display controller configured to control the state information displaying unit and to perform the method, the method comprising:

receiving the plural kinds of state information;

determining whether or not the plural kinds of state information comprise malfunction information indicating a malfunction of the work machine;

based on determining that the malfunction information is received, switching the first state information displayed in the first display area with the caution sign for reporting the malfunction information determined to be comprised in the plural kinds of state information; and based on the first state information being switched with the caution sign, switching the second state information displayed in the second display area with the first state information.

7. A computer-readable recording medium with a computer-readable caution-sign displaying program for a work machine recorded thereon, the program being provided to allow a state information display provided to the work machine to perform a caution-sign displaying method for the work machine, the method being configured to allow the state information display to display a caution sign, the state information display being configured to display plural kinds of state information of the work machine comprising first state information and second state information, the state information display comprising:

a state information displaying unit defining a first display area that displays the first state information and a second display area that displays the second state information; and a display controller configured to control the state information displaying unit and to perform the method, the method comprising:

receiving the plural kinds of state information;

determining whether or not the plural kinds of state information comprise malfunction information indicating a malfunction of the work machine;

based on determining that the malfunction information is received, switching the first state information displayed in the first display area with the caution sign for reporting the malfunction information determined to be comprised in the plural kinds of state information; and based on the first state information being switched with the caution sign, switching the second state information displayed in the second display area with the first state information.

* * * * *